US005810222A

United States Patent [19]

Shoemaker

[11] Patent Number: 5,810,222

[45] Date of Patent: Sep. 22, 1998

[54] HOLSTER WITH HANDGUN DETENT MEANS

[76] Inventor: Randy R. Shoemaker, 714 W. Cinega Ave., San Dimas, Calif. 91773

[21] Appl. No.: 721,839

[22] Filed: Sep. 27, 1996

[51] Int. Cl.[6] ..... F41C 33/02

[52] U.S. Cl. ..... 224/244; 224/192; 224/243; 224/245; 224/911

[58] Field of Search ..... 224/192, 243, 224/244, 245, 911, 912

[56] References Cited

U.S. PATENT DOCUMENTS 5,129,562 7/1992 Bianchi ..... 224/911

*Primary Examiner*—David J. Walczak
*Assistant Examiner*—Timothy L. Maust
*Attorney, Agent, or Firm*—Boniard I. Brown

[57] ABSTRACT

A handgun holster has detent features, preferably confronting detent jaws mounted on inside surfaces of the holster adapted to be displaced by the trigger guard of a handgun upon insertion of the handgun, then to move into engagement with the trigger guard to present detent force to resist handgun withdrawal. Substantial resistance is provided to withdrawal by an unauthorized person positioned in front of or to the rear of the person carrying the holster. Spacing between detent jaws may be provided by adjustable spacer mounting assemblies mounted between the holster sides.

14 Claims, 3 Drawing Sheets

HOLSTER WITH HANDGUN DETENT MEANS

BACKGROUND OF THE INVENTION

1. Field of the Invention

The present invention relates to handgun holsters, and particularly to improved features for resisting unauthorized withdrawal of handguns from holsters worn by users.

BACKGROUND

Handguns carried by users, such as law enforcement officers, must be readily withdrawable from the holster to provide timely and effective use in confrontations, emergencies and hazardous situations. It is convenient and desirable that a handgun holster be disposed on the hip of the user. A long existing and continuing problem faced by such users is the hazard and vulnerability of losing control of the handgun to an unauthorized person, typically in front of or behind the user.

2. Prior Art

Certain holster designs of the prior art have been provided in the effort to prevent unauthorized handgun withdrawal from holsters of users. It is well-known that some holsters have been provided with straps extending across the tops of the holsters, or with retaining features engaging trigger housings. Certain holsters have openings along the front edge, with sides pressing against the handgun therein so that the handgun is withdrawn by urging the handgun forward, thus to prevent or make difficult the upward withdrawal by an assailant from the rear of the user. Trigger guard pockets have been provided to resist unauthorized withdrawal of handguns.

Many users of handgun holsters, such as law enforcement officers, prefer conventional holsters as opposed to such holsters as those with open fronts. It is therefore desirable to provide safety features in conventional type holsters to prevent or make difficult unauthorized handgun withdrawal.

DESCRIPTION OF A PREFERRED EMBODIMENT OF THE INVENTION

Figure 6:
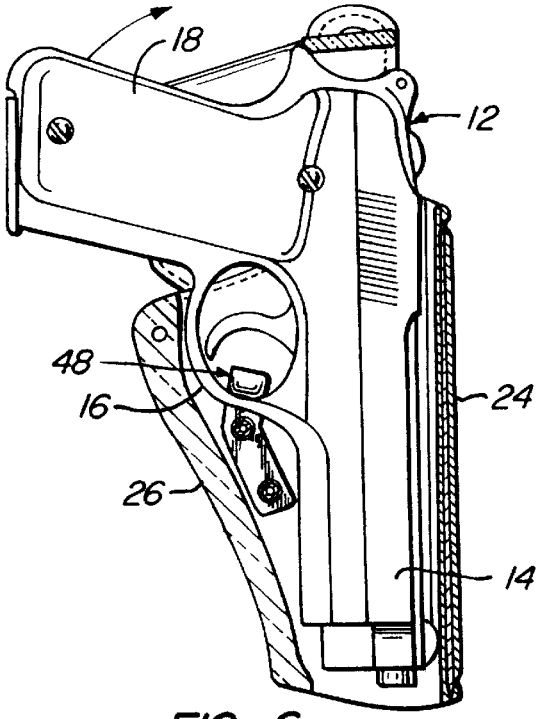
FIG. 6 is an elevational view of the holster of FIG. 1 with a handgun therein retained by detent jaws according to the invention.
Figure 7:
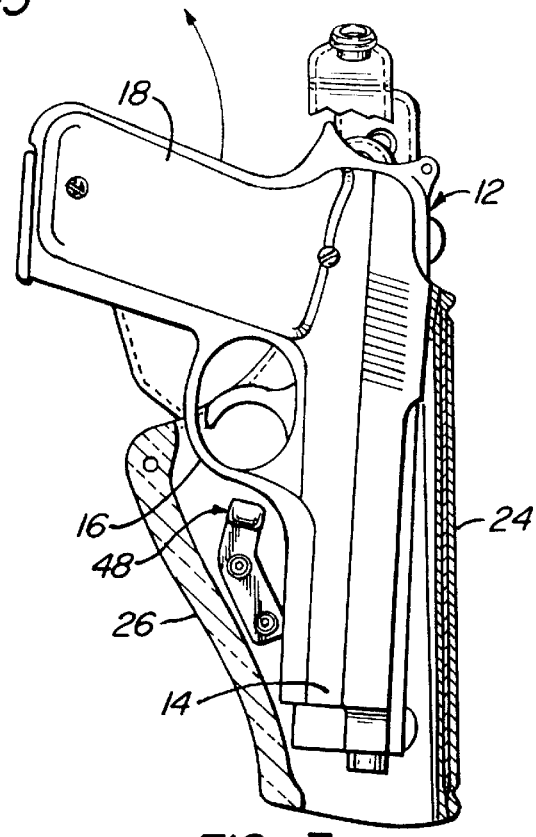
FIG. 7 is a view similar to that of FIG. 6, showing the handgun during insertion or withdrawal relative to the detention jaws according to the invention.

Referring to the drawings, a holster 10 utilized with the invention is shown in detail, with a showing of a handgun 12 in the holster (FIGS. 6–7). Typically, the handgun in the holster is an automatic handgun having a barrel 14, trigger guard 16 and handle 18. Preferably, as shown, the handgun handle or grip is exposed for easy grasp, while the trigger guard is covered by the holster.

Figure 3:
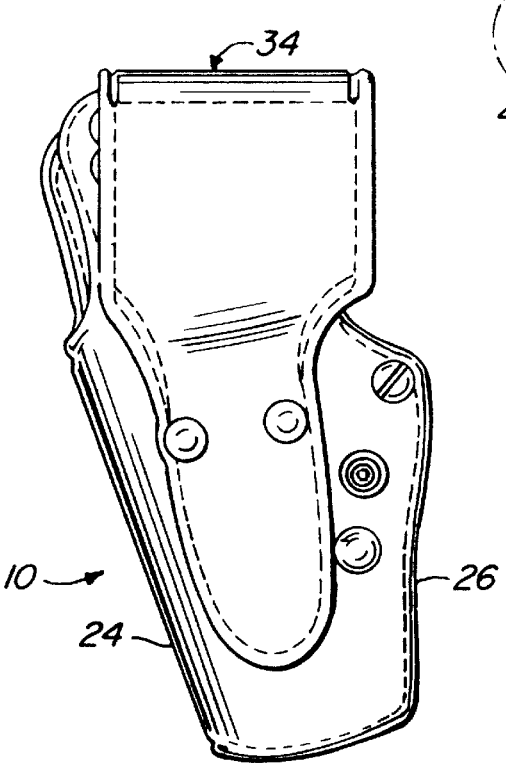
FIG. 3 is a side view of the holster of FIG. 1, opposite from that of FIG. 1.

The handgun is received in a pocket defined by holster inner and outer sides 20, 22 and a bent or folded front portion 24. The inner and outer sides are stitched together at the rear 26 of the holster (FIG. 3). The holster pocket is preferably sized for a relatively snug fit of the handgun to prevent lateral movement. The upper portion of the handgun contacts the front of the holster, with the trigger guard contacting the rear portion, thus to prevent play.

As shown, the holster inner and outer portions 20, 22 have an external layer 28 and an interior layer 30 separated by a metal reinforcement member 32 to provide improved rigidity.

Figure 9:
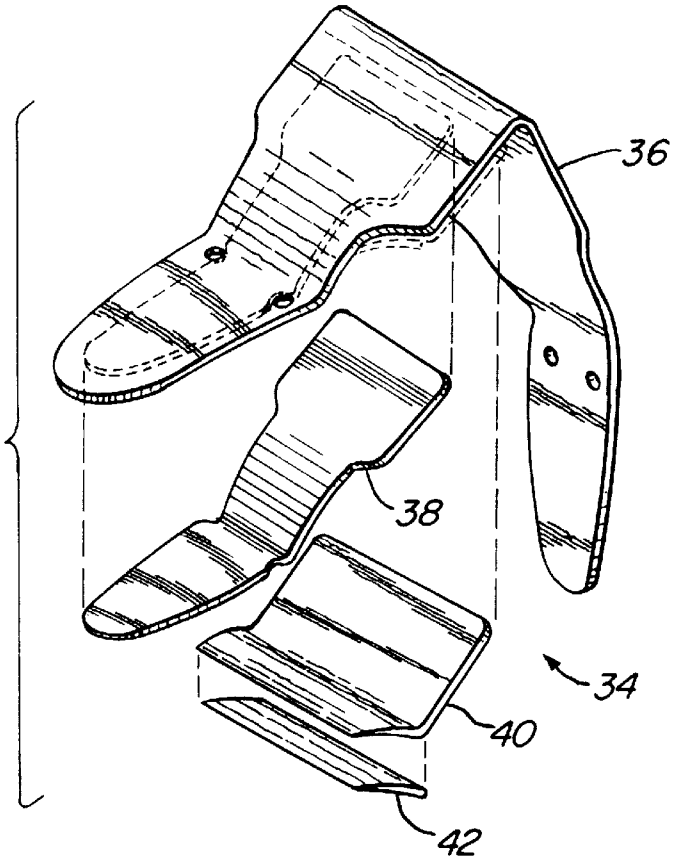
FIG. 9 is an exploded perspective view of components of a belt loop utilized with the holster according to the invention.
Figure 8:
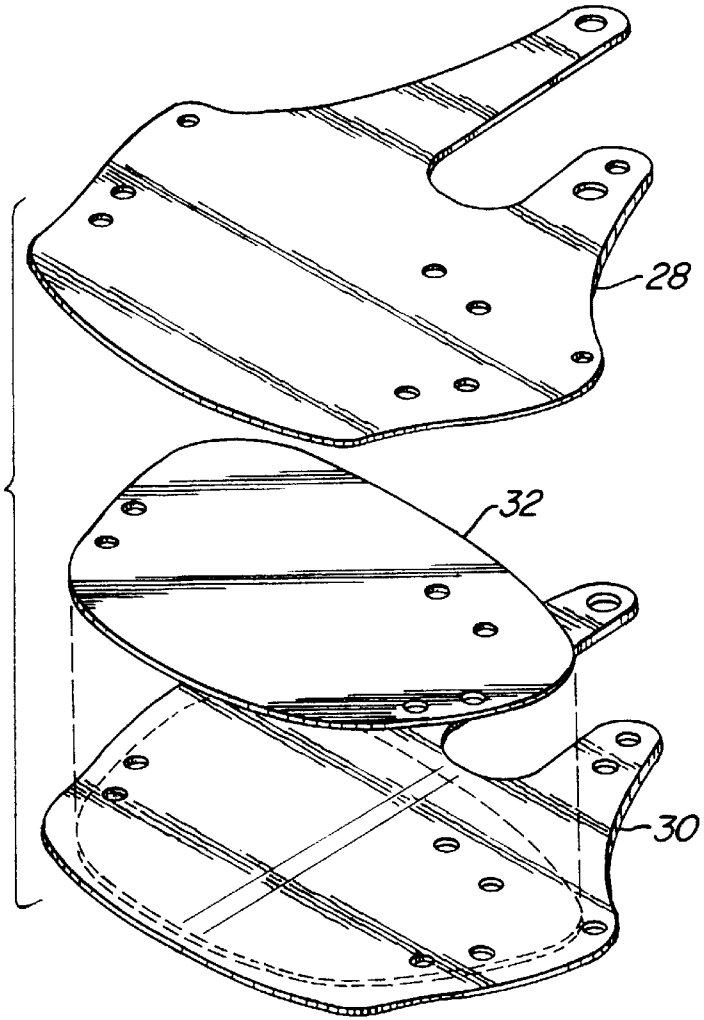
FIG. 8 is an exploded perspective view of components utilized to form a holster utilized with the invention.

A belt loop assembly 34 is mounted on the inner side of the holster by rivets, as shown (FIG. 3), and comprises a specially configurated leather member 36, a bent metal reinforcing member 38 and inserts 40, 42 (FIG. 9). The reinforcing metal members or plates are preferably formed of a material such as tempered spring steel to provide a permanent, rigid structure.

Figure 1:
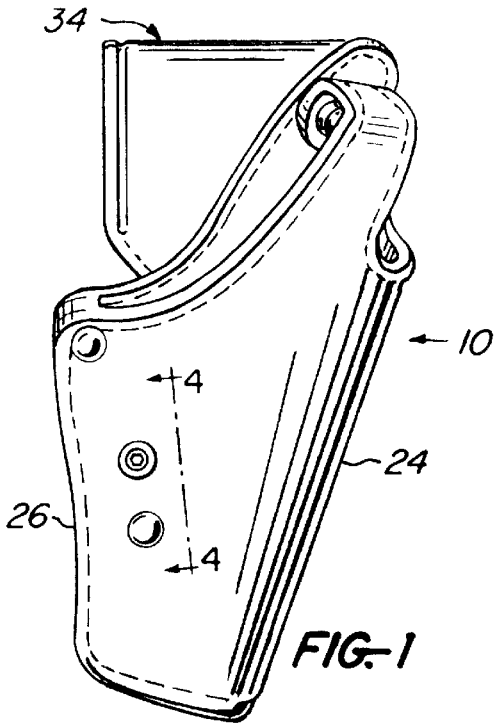
FIG. 1 is a side elevational view of a holster according to the present invention.
Figure 2:
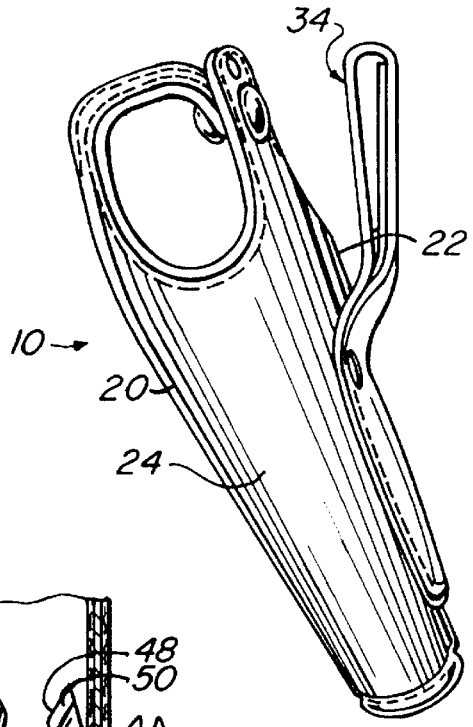
FIG. 2 is a front view of the holster of FIG. 1.
Figure 4:
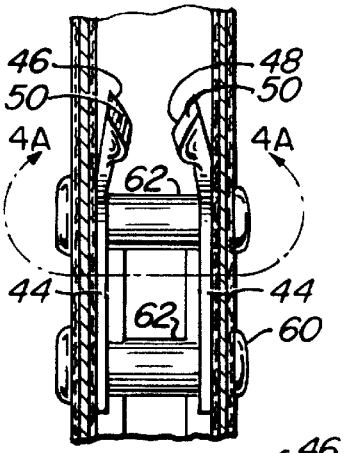
FIG. 4 is an enlarged sectional view taken at line 4—4 in FIG. 1.
Figure 5:
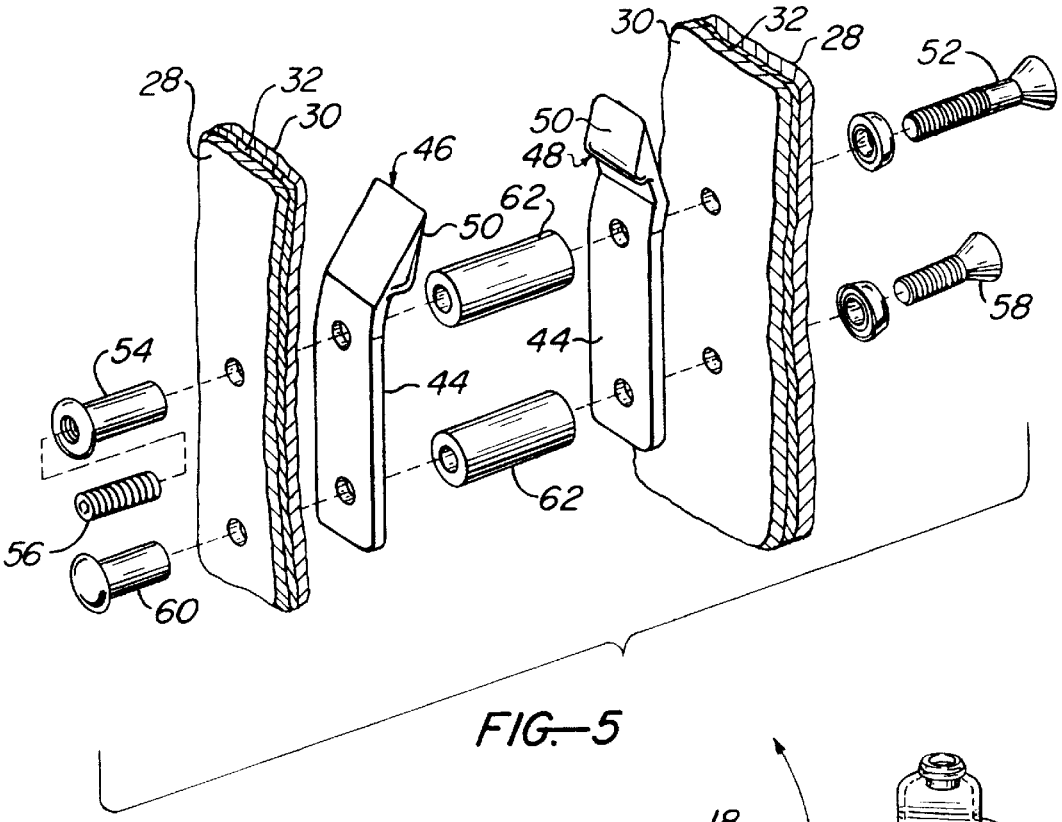
FIG. 5 is an exploded perspective view of a portion of the holster of FIGS. 1–4, showing details of construction and assembly components.

A pair of generally resilient jaws 46, 48 according to the invention, are mounted in confronting relation on the inner faces of the outer and inner holster sides, as best shown in FIGS. 4 and 5. The detent jaws are formed of appropriate resilient plastic material, and have mounting sections 44 wherein openings are defined for extension therethrough of mounting components. Each detent jaw has an upper engagement portion or head defining an inclined surface 50, as shown (FIGS. 4 and 5). The mounting sections 44 may preferably be inwardly inclined, as shown, to dispose the head portion inwardly from the inner surfaces of the holster sides.

Upper and lower threaded assemblies extend through openings in the holster side walls and through the openings in the detent jaw mounting sections. These assemblies serve to position the detent jaws and to adjustably space apart the inner and outer sides of the holster. The upper threaded assembly includes a male threaded fastener 52 and threaded female receptacle 54 having a threaded insert 56. The threaded fasteners are secured together and adjusted to space the inner and outer sides of the holster in accordance with the desired spacing between the detent jaws. This upper assembly serves as a jam nut or locking screw to secure the threaded assembly in selected position. The lower threaded assembly comprises a male threaded fastener 58 and a female threaded receptacle 60, the male threaded fastener 58 being rotatable by an appropriate tool, such as a screwdriver, to adjust the spacing between the holster sides in accordance with the desired spacing between the detent jaws.

Disposed about each of the upper and lower fastener assemblies is a tubular member 62 of resilient plastic material, such as surgical tubing, which is axially compressible to serve in the manner of a spring to compress and expand upon the tightening or loosening of the threaded assemblies, the tube end portions bearing against the mounting sections of the detent jaws to maintain a tight configuration. The resilient tubular member 62 on the upper threaded assembly also serves to cushion engagement between the gun trigger guard and the threaded assembly.

Figure 4A:
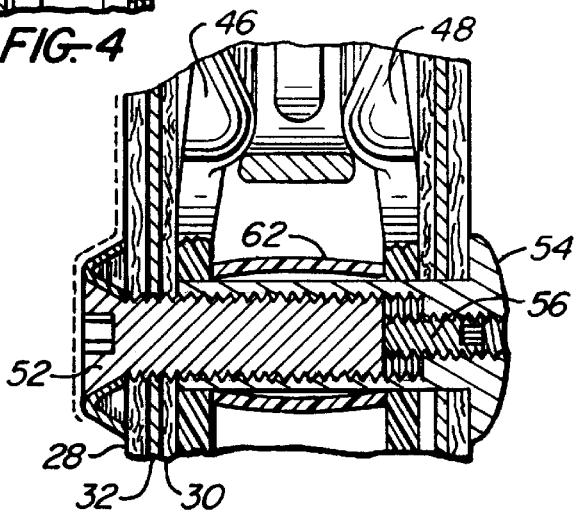
FIG. 4A is an enlarged view of a portion of FIG. 4 encircled at 4A—4A.

Utilizing the holster according to the invention, the handgun is urged downwardly into the holster pocket (FIG. 7) and the trigger guard 16 is urged against the detent jaws 46, 48 to urge the jaws outwardly, thus allowing the trigger guard 16 to pass the jaws, whereupon the detent jaws are resiliently urged outwardly from the sides of the holster and into engagement with the trigger guard 16, as indicated in FIG. 6. That is, the trigger guard, in a snap-pass action by the jaws is engaged and retained by the detent jaws (FIG. 4A).

The user, such as a police officer, can readily withdraw the handgun from the holster, preferably by a quick forward motion at the handle 18, then an upward movement in the direction of the axis of the handgun barrel 14.

It is difficult for an unauthorized person, such as an assailant or criminal, to withdraw the handgun from the holster at the side of the user, whether the unauthorized person be in front of or behind the user. Generally, the unauthorized person would lack knowledge of the detention jaws in the holster and of the best manner of withdrawing the gun in the presence of the detention jaws. The unauthorized person can withdraw the gun only with significant difficulty and delay, thus resulting in substantial security for the user or police officer who has more time to act to prevent withdrawal by the unauthorized person. The unauthorized person, in grabbing the gun either from a position in front of or a position behind the user, must generally grasp and pull the handgun at a significant angle from the barrel axis, thereby producing quite significant drag or binding action, making the handgun very difficult to withdraw. Thus, if he attempts to withdraw the gun from a position in front of the user, there is a binding action or drag produced between the retention jaws 46, 48 and the upper front portion of the holster. If he attempts to grab and withdraw the handgun from a position to the rear of the user, a binding or drag action is produced between the jaws 46, 48 and the rear portion of the holster adjacent to the trigger guard (FIG. 6).

Thus there has been shown and described a novel holster with handgun detent means which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The Inventor claims:

1. In a holster having inner and outer sides, an open top, and means for connection with a user, for a handgun having a handle and a trigger guard:

handgun detent means in the holster and comprising at least one detent jaw having a surface inclined to the direction of insertion of the handgun into the holster, whereby said at least one detent jaw is displaced by the trigger guard and then engages the trigger guard to provide a detent action against withdrawal of the handgun from the holster, spacer mounting means between the holster inner and outer sides to mount the at least one detent jaw and to space apart the holster sides, said spacer mounting means being quickly adjustable exteriorly in length for selective adjustment of the spacing between the holster inner and outer sides, whereby the handgun is withdrawable from the holster upon exertion of normal force in the general direction of the handgun barrel axis, and increased resistance is presented to handgun withdrawal in directions inclined forwardly or rearwardly relative to the handgun barrel axis.

2. A holster according to claim 1, wherein:

the increased resistance to handgun withdrawal is provided by a binding engagement between the at least one detent jaw and an upper front portion of the holster when attempt is made to withdraw the handgun in a direction forwardly of a user, and the increased resistance is produced by binding between said at least one detent jaw and a portion of the holster adjacent to the trigger guard when withdrawal is attempted in the direction rearwardly of the user.

3. A holster according to claim 1, wherein:

said spacer mounting means comprise at least one spacer mounting threaded assembly comprising a threaded screw and a threaded female receptacle for adjustment of the spacing between the holster inner and outer sides.

4. A holster according to claim 3, and further including:

a resilient tubular member disposed about the at least one spacer mounting assembly to provide a resilient spring action to maintain close engagement of the threaded assembly with the holster sides.

5. A holster according to claim 4, wherein:

said resilient tubular member has an inner diameter greater than the diameter of the spacer mounting assembly for compression and extension thereof to accommodate adjustment in the length of the spacer mounting assembly to maintain close engagement of the spacer mounting assembly with the holster sides.

6. A holster according to claim 4, wherein:

said resilient tubular member cushions engagement between the trigger guard and the upper spacer mounting assembly.

7. A holster according to claim 1, wherein:

said spacer mounting means comprise upper and lower spacer mounting assemblies, each comprising a threaded screw and a threaded female receptacle for adjustment of the spacing between the holster inner and outer sides.

8. A holster according to claim 7, wherein said threaded screw and receptacle each have an enlarged retaining portion to retain the assembly relative to exterior surfaces of the holster sides.

9. A holster according to claim 7, and further including:

a resilient tubular member disposed about each of the upper and lower spacer mounting assemblies.

10. A holster according to claim 9, wherein each of the tubular members has an inner diameter greater than the diameter of the spacer mounting assembly for compression and extension thereof to accommodate adjustment in the length of the spacer mounting means to maintain close engagement of the spacer mounting means with the holster sides.

11. A holster according to claim 1, and further including:

a resilient tubular member disposed about the spacer mounting means to provide a resilient spring action to maintain close engagement of the threaded assembly with the holster sides.

12. A holster according to claim 11, wherein:

said resilient tubular member has an inner diameter greater than the diameter of the spacer mounting means for compression and extension thereof to accommodate adjustment in the length of the spacer mounting means to maintain close engagement of the spacer mounting means with the holster sides.

13. A holster according to claim 11, wherein:

said resilient tubular member cushions engagement between the trigger guard and the upper spacer mounting assembly.

14. A combination according to claim 1, wherein:

two detent jaws are mounted in confronting relation in said pocket, one on each of said inner and outer holster sides.

* * * * *